US009878831B2

(12) United States Patent
Danielsson et al.

(10) Patent No.: US 9,878,831 B2
(45) Date of Patent: Jan. 30, 2018

(54) CAP WITH A CUTTING ELEMENT

(71) Applicant: Tetra Laval Holdings & Finance S.A., Pully (CH)

(72) Inventors: Anders Danielsson, Hörby (SE); Göran M Johansson, Stehag (SE); Fredrik Nordgren, Tygelsjö (TW); Robert Rosberg, Hörby (SE); Jennie Stackebo, Bjärred (SE); Henrik Andersson, Malmö (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 0 days.

(21) Appl. No.: 14/900,549

(22) PCT Filed: Jun. 16, 2014

(86) PCT No.: PCT/EP2014/062535
§ 371 (c)(1),
(2) Date: Dec. 21, 2015

(87) PCT Pub. No.: WO2014/202518
PCT Pub. Date: Dec. 24, 2014

(65) Prior Publication Data

US 2016/0152386 A1 Jun. 2, 2016

(30) Foreign Application Priority Data

Jun. 20, 2013 (SE) ..... 1350756-1

(51) Int. Cl.
*B65D 41/34* (2006.01)
*B65D 51/22* (2006.01)
*B65D 55/08* (2006.01)

(52) U.S. Cl.
CPC ..... *B65D 41/34* (2013.01); *B65D 41/3428* (2013.01); *B65D 51/222* (2013.01); *B65D 55/08* (2013.01); *B65D 2555/025* (2013.01)

(58) Field of Classification Search
CPC ..... B65D 51/228; B65D 2251/0015; B65D 2251/0093; B65D 2251/0071; B65D 51/22
See application file for complete search history.

(56) References Cited

U.S. PATENT DOCUMENTS 5,090,581 A * 2/1992 Rose ..... B65D 51/228 215/253
8,851,310 B2 * 10/2014 Pucci ..... B65D 51/228 215/252

(Continued)

FOREIGN PATENT DOCUMENTS

CN 102905986 A 1/2013
DE 10 2011 017793 A1 10/2012

(Continued)

OTHER PUBLICATIONS

International Search Report (PCT/ISA/210) dated Aug. 20, 2014, by the Japanese Patent Office as the International Searching Authority for International Application No. PCT/EP2014/062535.

(Continued)

*Primary Examiner* — Shawn M Braden
(74) *Attorney, Agent, or Firm* — Buchanan Ingersoll & Rooney PC

(57) ABSTRACT

A cap arranged to interact with a spout has a top portion, a sidewall portion depending from the top portion and formed in one piece therewith. The sidewall portion has an interior threading arranged to interact with exterior threading of the neck during an opening operation and during a closing operation. The cap further has a tamper evidence, which is removably attached to the sidewall portion having cutting (Continued)

elements with a first end hingedly attached to the sidewall portion and a free end portion arranged to interact with a membrane portion of the spout. The hinged attachment allows for the cutting element to pivot in an axial direction. Further, the free end portion has a blunt tip and a comparatively sharper cutting edge on a lateral side of the free end portion.

18 Claims, 2 Drawing Sheets

(56) References Cited

U.S. PATENT DOCUMENTS

| | | | | |
|---|---|---|---|---|
| 9,096,359 | B2 * | 8/2015 | Pucci | B65D 51/228 |
| 9,517,869 | B2 * | 12/2016 | Ammann | B65D 51/228 |
| 2011/0155687 | A1 | 6/2011 | Ammann | |
| 2013/0062305 | A1 * | 3/2013 | Dahl | B65D 5/746 215/257 |
| 2014/0137717 | A1 | 5/2014 | Barron | |
| 2014/0319142 | A1 * | 10/2014 | Johansson | B65D 41/045 220/284 |

FOREIGN PATENT DOCUMENTS

| | | | |
|---|---|---|---|
| EP | 0 421 821 | A1 | 4/1991 |
| FR | 2 150 226 | A1 | 4/1973 |
| FR | 2 176 486 | A1 | 11/1973 |
| FR | 2 234 206 | A1 | 1/1975 |
| FR | 2 659 298 | A1 | 9/1991 |
| WO | WO 2008/148764 | A2 | 12/2008 |
| WO | WO 2013/072475 | A1 | 5/2013 |

OTHER PUBLICATIONS

Written Opinion (PCT/ISA/237) dated Aug. 20, 2014, by the Japanese Patent Office as the International Searching Authority for International Application No. PCT/EP2014/062535.

* cited by examiner

CAP WITH A CUTTING ELEMENT

TECHNICAL FIELD

The invention generally relates to the field of packaging technology. More particularly, the invention relates to a cap with a cutting element. The invention also relates to a spout arranged to interact with the cap, a bottle provided with the spout, and a method for applying the cap onto the spout.

BACKGROUND OF THE INVENTION

Within the field of food packaging, and packaging of any perishable product, it is of concern to contain the product in a safe way until it reaches the end consumer. Even more so, the end consumer should preferably be able to judge whether the product is safely contained or not before acquiring the product. This is particularly true for the closure of the package. A regular screw-cap closure may be opened and reclosed without causing any visible leakage, yet breaking the hermetic seal may hamper the quality of the product in a dramatic way. This is one of the reasons to why tamper evidence has been introduced. A common tamper evidence is the well known tamper ring, which is torn of the cap as the container is opened for the first time. The functionality of the tamper ring may vary, and there are numerous options available. Also, there are other tamper evidences too, such as lacquer seals and various shrink plastic arrangements, etc.

The closure of a packaging container has to fulfill several demands. It should provide adequate barrier properties, such that liquids or gas does not pass into or out of the container before it is opened for the first time. Also, it should provide adequate resealing properties such that no leakage occurs after the first opening. Additional demands are that it should be easy to open, efficient to manufacture and appealing to the eye.

A thorough overview of the technical field is disclosed in WO2008148764 to SACMI, and it is considered that the skilled person would have no problem in realizing the present invention after studying the teachings disclosed herein combined with the prior art. One example is that the present invention does not discuss moulding of plastic closures. Even if this knowledge is essential for the manufacture of plastic closures, it does not define the present invention in the light of prior art and is therefore considered superfluous for the purposes of disclosing the present invention in a sufficiently detailed manner for the skilled person to practice it.

SUMMARY

In an effort to provide an improved opening device the present invention, according to one aspect thereof, provides a cap arranged to interact with a spout. The cap comprises a top portion, a sidewall portion depending from the top portion and formed in one piece therewith, the sidewall portion comprising an interior threading arranged to interact with exterior threading of the neck during an opening operation and during a closing operation. Further, the cap comprises a tamper evidence removably attached to the sidewall portion, and the sidewall portion further comprises cutting elements having a first end hingedly attached to the sidewall portion and a free end portion arranged to interact with a membrane portion of the spout, wherein the hinged attachment allows for the cutting element to pivot in an axial direction. The cap is characterized in that the free end portion has a blunt tip and a comparatively sharper cutting edge on a lateral side of the free end portion. This design facilitates initial arrangement of the cap onto a neck or spout, and it also provides an adequate operation during use of the device.

According to one or more embodiments the blunt tip of the cutting elements are arranged to penetrate the neck portion in the region of the membrane portion during a first sequence of a first opening operation, and wherein the cutting edge is arranged to cut the membrane portion from the neck portion during later stages of the first opening operation, and wherein the cutting elements are arranged to hold the removed membrane portion in an area between the cutting elements and the top portion. Before being utilized the first time for opening purposes the cutting elements will lean onto the neck or spout of the packaging container, directed in an opening direction (towards an opening end of the packaging container). As the cap is unscrewed the cutting element will pivot and eventually be forced towards a weakened region of the membrane and penetrate the same, in a way to be further explained in the detailed description.

According to one or more embodiments the cutting elements comprises a local protrusion extending from an axial side of the cutting element, resulting in advantages to be describe in the detailed description. In a related embodiment the local protrusion is arranged at an axial side facing the tamper evidence and/or to a side remote to the cutting edge.

In one or several embodiments the local protrusion may have an elongated extension in a radial direction, such that it may be in contact with a newly cut edge of the neck during the first opening operation.

In still further embodiments stop elements extend from the top portion along the sidewall portion, preferably being formed in one piece therewith, the stop elements being configured to contact a cooperating circumferential counter element of the neck to limit the movement of the cap in an axial direction. The use of an additional stop element not interfering with other functional portions of the cap will enable tailormade solutions in these other functional portions.

It is preferred, though not a necessity, that the cap is moulded in one piece. A suitable material for the cap is polypropylene, though the materials or compounds of materials are possible.

According to another aspect of the present invention it relates to a method for arranging a cap of any preceding claim onto a neck, comprising the steps of arranging the cap in a cap-holder device, aligning the cap with a neck, positioning the cap onto the neck by means of a relative axial movement.

In one or more embodiments the step of positioning the cap also comprises a relative rotational motion. When screwing the cap into position an extra added value is obtained from embodiments of the cap including the protrusions.

According to one or several embodiments the method further comprises the preceding step of moulding a neck onto a paper-based container sleeve.

The cap may be made of polypropylene. Since polypropylene is harder than High Density PolyEthylene (HDPE) a cap made of polypropylene may advantageoulsy be used with a spout made of HDPE. An advantage of having the spout made of HDPE is that the shelf life of the liquid food stored in a bottle provided with the spout may be prolonged since the liquid food is less affected by the outside conditions due to the more resistent material in the spout. More particularly, a spout made of HDPE has a lower Oxygen Transmission Rate (OTR) than, for instance, a spout made of Low Density PolyPropylene (LDPP), which has the positive effect that less oxygen will enter the bottle or the package provided with the spout through the spout, which in turn has the effect that the liquid food in the bottle or package may be stored for a longer period of time without being unsafe to consume.

Another advantage of having a spout made of HDPE is that a more roboust package is achieved having the effect that more packages or bottles provided with spouts made of HDPE can be piled on top of each other.

There are other possible solutions for obtaining the right performance for the spout and the cap. One example is that instead of using a pure material, such as PP for the cap or HDPE or LDPE for the spout a compound, mixture or layered construction may be used. E.g. an inferior pure material may be improved by additives, and by adding an extra barrier layer the OTR may be adjusted. Such considerations may be relevant for various applications of the present invention in terms of being relevant for caps and spouts as such, yet they are not important for the understanding of the present invention as defined by the claims According to a fifth aspect a method for packaging liquid food in a bottle is provided. The method comprising forming a body portion of said bottle in the form of a sleeve of a carton-based laminate, forming a top section of said bottle, said top section comprising a spout according the second aspect, joining said top section to said body portion, filling said bottle with liquid food via an open end of said bottle, sealing said open end of said bottle, and applying a cap according to the first aspect onto said spout according to the fourth aspect.

The step of forming said top section of said bottle may comprise molding said spout.

The spout may be applied onto said spout such that a spout neck combination is formed, and said forming said top section of said bottle may comprise molding a top section such that said spout of said spout neck combination is joined to said top section.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, wherein.

DETAILED DESCRIPTION OF PREFERRED EMBODIMENTS

Figure 1:
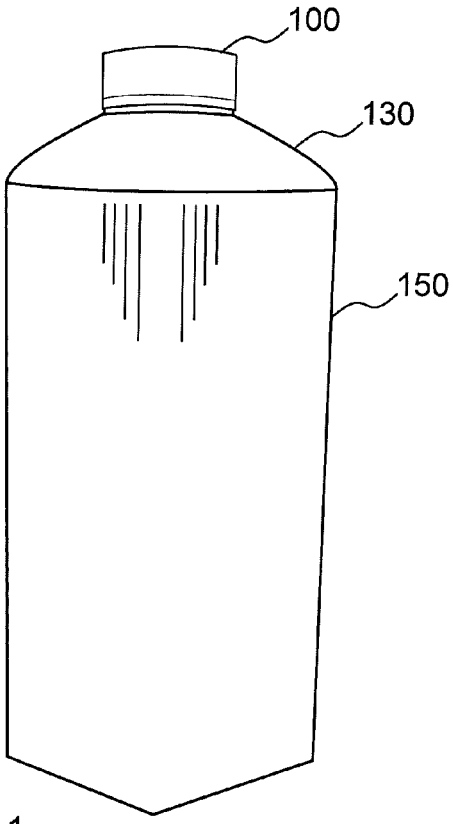
FIG. 1 illustrates a carton-based bottle having a top section made of plastic and a body made of carton-based laminate.

To put the present invention into context a packaging container is shown in the perspective view of FIG. 1. This is a type of packaging container which may utilize an cap according to the present invention. It should be noted that an inventive cap, inventive neck, etc may be used in combination with other packaging containers too. Returning to the packaging container of FIG. 1, it is composed of three constructional parts. A sleeve 150 is attached to a shoulder/neck portion 130, and a cap 100 is arranged on the neck. It is a typical example of a Tetra Top® container, which is a well known carton bottle concept from the present applicant. The shoulder/neck portion 130 is moulded in one piece directly onto the sleeve 150, after which a cap 100 is screwed onto the neck. The sleeve 150 is formed from a packaging laminate of standard design, i.e. a paper core with surrounding laminate layers also well known in prior art.

Figure 2:
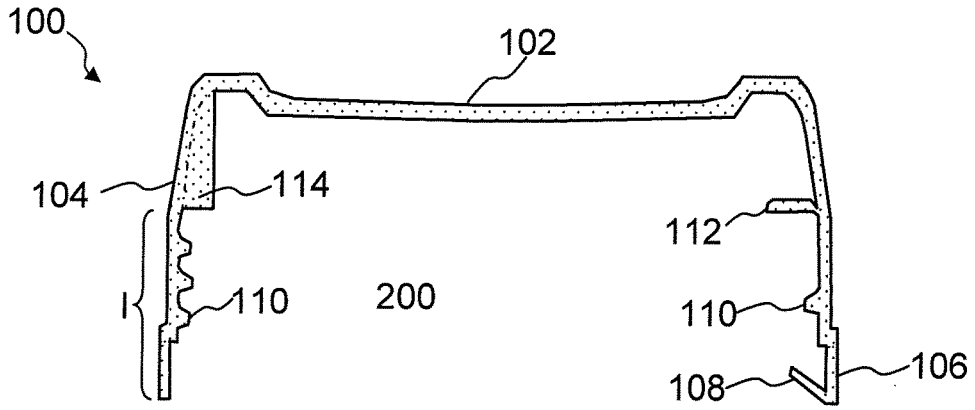
FIG. 2 illustrates a cap according to a first aspect of the present invention.

FIGS. 1 and 2 illustrates a cap and a neck respectively according to a first embodiment of the present invention. Several constructional features are similar to what has already been disclosed in the patent application PCT/EP2012/072868, which was filed yet not published at the time of filing of the present application. In particular, for details regarding the membrane portion 202 of the neck, and how it cooperates with the upper rim of the spout when resealing, reference is made directly to corresponding disclosure of PCT/EP2012/072868.

The cap 100 as shown in FIG. 2 comprises a disc-shaped top portion 102. The top-portion may be flat, or have another shape, such as the one shown in FIG. 2, i.e. have a central depression over a majority of the surface. In the embodiment of FIG. 2 the top portion displays rotational symmetry, which is often the case.

A sidewall portion 104 depends from the top portion 102, in what may be referred to as a generally axial direction. The exterior side of the sidewall portion 104 may be designed for e.g. appearance and for increasing gripability, yet for the purposes of the present invention it is the interior side of the sidewall portion 104 that is of concern.

A tamper evidence 106 is arranged a a lower end of the sidewall portion 104. The tamper evidence 106 is preferably formed in one piece with the sidewall portion 104, and this with the rest of the cap 100 for that matter, and is designed to break away from the sidewall portion 104 as the cap 100 is removed for the first time. For this reason there is a weakened area defining the interface between the sidewall portion 104 and the tamper evidence 106. The weakened area, indicated by a dotted line in FIG. 2 may be arranged during moulding of the cap 100, or during post-moulding processing, e.g. by slitting the cap such that the interface consists of a finite number of material bridges and/or an area with material of smaller thickness in a radial direction. Such techniques are well known in literature, and with the purpose of being brief on details not relevant in isolation we will leave it to that.

Several tamper tabs 108 extends from a portion of the tamper evidence 106, in the present embodiment from an end portion remote from the top portion 102. The tamper tabs 108 are likewise formed in one piece with the tamper evidence 106 and comprises a free end and and opposite end being hingedly supported by the tamper evidence 106. The tamper tabs 108 have two main purposes. Firstly, they should prevent the tamper evidence from rotating relative to the container neck as the cap 100 is unscrewed from the neck, and secondly they should prevent the remaining tamper evidence from being pulled off the neck in an axial direction. There are numerous tamper-tab designs available, and the one disclosed in the present embodiment is to be considered a standard solution. The skilled person could select one of several such standard solutions without departing from the scope of the present disclosure. The function of the tamper tabs 108 relies on cooperating elements of the neck, which will be discussed later, referring to FIG. 3. In the present embodiment there are a discrete number of tamper tabs 108 distributed around the circumference of the tamper evidence 106. Turning in the direction of the top portion and on the interior side of the sidewall portion 106, internal threads 110 are arranged. There may be several sets of threads, i.e. several separate threads forming a thread assembly, such as e.g. three main threads starting from different locations of the lower perimeter of the interior of the sidewall 104, suggestively evenly distributed and running in parallell up the interior of the sidewall 104. These main threads may be segmented, such that the thread is absent during part of its path. Whatever design the thread has, it is designed to cooperate with an exterior thread 210 of the neck 200 (see FIG. 3).

Following the threads 110 cutting elements 112 are arranged. Specific features of these form a central part of one aspect of the present invention and they will be described later in reference to FIGS. 5 and 6. The purpose of the cutting elements or knives 112 is to penetrate a section of the neck 200, below a membrane portion 202 thereof, and to separate that membrane portion 202 from the rest of the neck 200. After that step, the cutting elements 112 serve the purpose of securing the membrane portion 202 in an axial position between the cutting elements 112 and the interior of the top portion 102. This will reduce the amount of litter generated, yet the technical reason is that the membrane portion 202 serves an important purpose when resealing the closure. There are a number of cutting elements 112 distributed around the perimeter of the sidewall portion 104. In the present embodiment there are five. The number of cutting elements 112 will depend on several factors, yet one important factor is the rising of the threads 110/210. The cutting action is effected when unscrewing the cap 100, and the cutting elements 112 will follow the rotational motion of the cap 100 as well as the axial movement thereof, all relative to the neck 200. This implies that the cutting action, or "removal action" to be more general, have to be finalized within a certain turning angle since otherwise the axial movement will move the cutting element 112 out of reach from the area to be cut. So, the steeper the rising of the threads, the more cutting elements 112 are needed. On the other hand, each cutting element 112 will generate a torque resistance when the cap 100 is unscrewed the first time, and in order to reduce the opening torque to acceptable levels it is not wise to have too many cutting elements 112. Hence, for the present embodiment five cutting elements 112 have been used, yet it is up to the skilled person to deduce a suitable number.

At about the same axial position as the cutting elements 112 stop elements 114 are arranged. In the present embodiment the stop elements are realized by stop ledges 114, i.e. flanges extending from the top portion 102 down to a specific axial position, and a small distance radially inwards. In the present embodiment there are a total of five stop ledges 114 and they are dimension so as to allow for the membrane portion 202 to fit between them. The purpose of the stop elements is to prevent the cap 100 from being screwed to far down (i.e. in a closing direction) onto the neck 200, and thus to prevent damage to membrane portion 202 during application of the cap 100 or when resealing the closure after initial opening. The stop elements of the cap cooperate with a counter element 214 of the neck 100. The distance from the lowermost portion of the stop elements 114 and the lowermost portion of the tamper evidence 106 is designated I, as shown in FIG. 2. "Lowermost" could be read as "most remote to the top portion 100" and refers to a normal position of the cap when applied onto a standing container. For the tamper evidence 104 "lowermost" corresponds also to the free end.

There are other means for preventing the cap from rotating any further once it has reached a certain position on the neck. Examples include various stop arrangement on in the thread, may it be a physical block at the end of the threads 210 of the neck which the threads cannot override, or a change in rising of the threads of the neck preventing further rotation of the cap. There are more options available. The solution used in the present embodiment is simple, straightforward, does not involve any other operational parts of the cap or neck, as well as being predictable, straightforward and providing a distinct stop.

Figure 3:
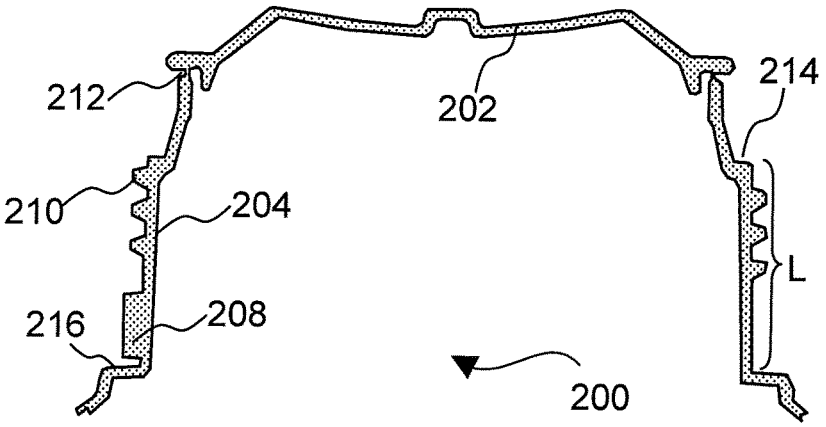
FIG. 3 illustrates a neck according to a second aspect of the present invention.

FIG. 3 illustrates the neck 200, parts of which have already been described. Starting from the top a membrane portion 202 is arranged. The shape and features of the membrane portion 202 are important for various functions, and these are exensively described in the patent application already cited. These features will offer the same advantages in the present context and as such they may be incorporated in preferred embodiments of the present invention, yet they are not essential for the present invention as such. The membrane portion 202 bridges to a spout portion 204 via connection portion 203. The connection portion 212 is a circumferential portion of reduced material thickness, which is analogous to a weakening line. The cutting elements 112 will separate the membrane portion 202 from the spout portion 204 in the connection portion 212.

In the initial position, before unscrewing the cap 100 the first time, the cutting elements 112 are positioned at an axial distance from the area to be cut, and it is of importance that the tamper evidence 106 breaks away from the cap 100 before the cutting action of the cutting elements is initiated.

Next to the connection portion 212, on the side of the spout, the area which is to be the rim of the spout is located, which in turn connects to the area of the spout portion 204 where the exterior threads 210 are located. As for the interior threads 110 of the cap the threads 210 may be an assemble of several threads. Between the area of the threads and the rim the counter element 214 is located. The counter element 214 is basically a circumferential ledge with a contact surface extending in a generally radial direction. The stop element 114 of the cap 100 is sized to abut the counter element 214 as the cap 100 is screwed onto the neck 200. The element following the threads 210 is a stop lug 208. The stop lug 208 (there are several such stop lugs arranged distributed along the circumference of the neck) extends radially from the neck and is designed to cooperated with the tamper tabs 108 of the cap 100 in order to prevent the tamper evidence 106 from rotating in relation to the neck. The stop lug 208 may be designed to efficiently engage with the tamper tab 108, e.g. by being undercut in an opening direction such that it engages with a gripping engagement with a tamper tab 108 in an opening direction. The opposite side of the stop lug 208 may be gently slanted such that a tamper tap 108 easily slides over it when passing in a closing direction. This makes it possible to easily arrange the cap on the neck when applying it for the first time. It is often desired to break the tamper evidence 106 as soon as possible, and the highest of the frequency at which the stop lugs 208 are arranged around the circumference of the neck and the frequency at which the tamper tabs 108 are arranged around the circumference of the cap 100 will be the determining factor, at least at a first approximation.

After the tamper evidence 106 has been released from the cap 100 their engagement with the lowermost portion of the threads 210 will secure the tamper evidence 106 to the neck 200. In an alternative embodiment a circumferential lock flange arranged below the threads 210 could fulfil the same purpose.

Below the stop lug 208 a circumferential flange 216 is arranged, acting as a transition to the shoulder portion of the container, if arranged on a container as the one depicted and described in relation to FIG. 1. In other embodiments the flange 216 may be used as an attachment area for attaching the neck onto a package.

The distance between the counter element 214 and the flange 216 is designated L, and in an embodiment where the cap 100 and the neck 200 are used in combination it is preferred that the relationship L>I is fulfilled. Preferably L should be at least one or so millimeters larger than I, such as 1 mm or 2 mm, or 0.8 mm or 1.2 mm, or another distance between 1 or 2 mm. One reason is that once the tamper evidence 104 is released it will fall down by gravity in a resting position towards the flange 216. However small, the gap of a mm or so will be readily spotted, indicated that the packaging container has been opened.

Though described separately, it is preferred that all portions of the neck is manufactured in one piece during a single moulding operation.

Figure 4:
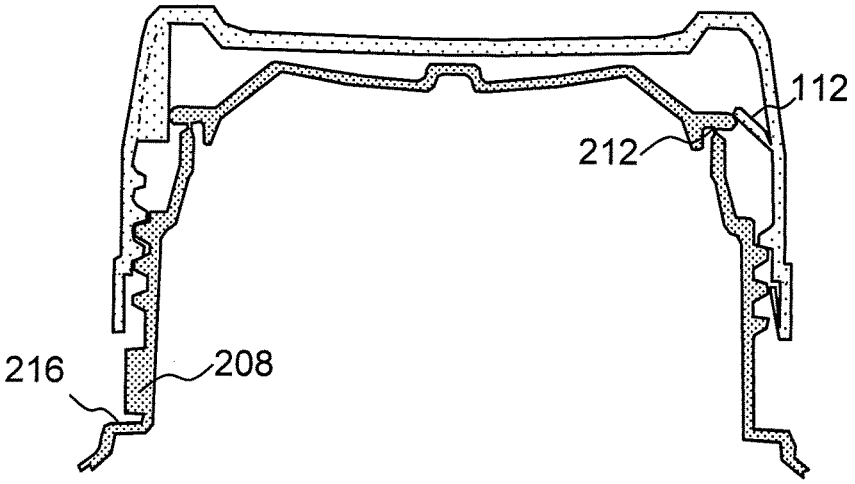
FIG. 4 illustrates a cap/neck assembly according to a third aspect of the present invention.

FIG. 4 illustrates a moment in time where the cap is being screwed onto the neck. Every constructional detail shown has already been described in relation to FIGS. 2 and 3, yet FIG. 4 is believed to simplify the understanding of their cooperation. Further referring to FIG. 4 it is worth mentioning that it is of importance that the cutting element is not allowed to pivot past an horizontal position (in the direction of the view of FIG. 4), since this will hamper the function of the cutting elements 112. A straightforward solution is to ensure that the length of the cutting element exceeds a clearance between the sidewall portion 104 and the spout portion 204. During opening, the free end of the cutting element 112 will be locked in a vertical position by the portion of the membrane extending beyond the spout portion 204 (i.e. it will be localized at the weakening or connection portion 212) and as the cap is moved further in an opening direction the tip of the cutting element 112 will penetrate the connection portion 212. After being severed from the spout the membrane portion 102 will be securely localized by the cutting elements 112.

Figure 5:
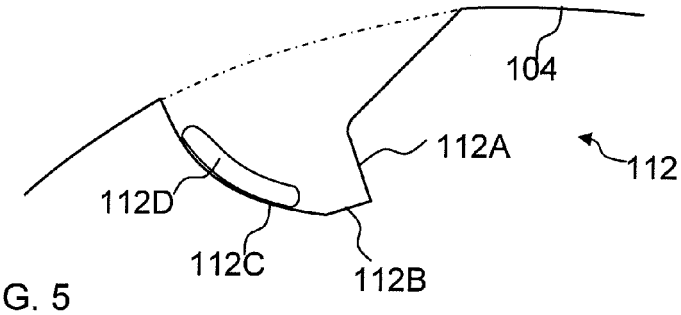
FIG. 5 illustrates a first side of a cutting element according to one embodiment thereof.
Figure 6:
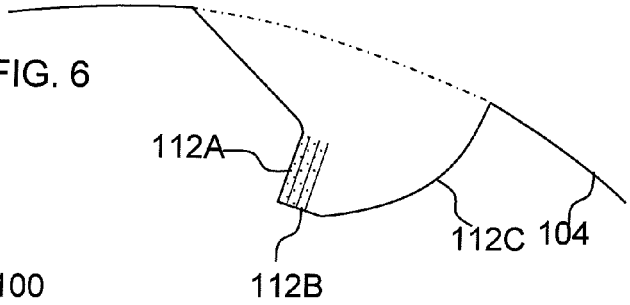
FIG. 6 illustrates the cutting element of FIG. 5 from the reversed side.

The cutting element 112 will now be described in more detail referring to FIGS. 5 and 6. FIG. 5 is schematic plan view from below, i.e. showing the side of the cutting element 112 which will be directed towards the spout when in use. FIG. 6 is a schematic plan view from above, i.e. showing the side of the cutting element which will be directed towards the membrane portion 102 when in use.

The cutting element 112 is hingedly attached to the interior side of the sidewall portion 104, see dashdotted line in FIGS. 5 and 6. This hinged attachment may be realized by means of an area of reduced thickness of the material, such that the cutting element 112 may pivot in relation to the hinged attachment. The region 112A is the cutting region of the cutting element 112, and in this region the thickness of the cutting element 112 is reduced to form an cutting edge 112A. The cutting edge 112A may be rectilinear, as in the present embodiment.

The free end 1128, remote to the hinged attachment may preferably be blunt, and may preferably be less sharp than the cutting region 112A. The results is the benefit that the free end is not prone to damage the connection region between the membrane portion and the spout portion when it is not supposed to. This may e.g. when the cap is arranged on the spout for the first time.

The exact design of the remaining portion 112C of the cutting element 112 is less important, though it should be designed to promote constructional stability of the cutting element, or at least not act detrimental to the same.

A key feature for one aspect of the present invention, or at least to an embodiment thereof, is shown at 112D. The feature is an elevated section or protrusion 112D extending from the surface of the cutting element 112, while being formed in one piece therewith. The protusion 112D is arranged on the side which faces away from the top portion 102 of the cap 100. In relation to the neck 200 the protrusion 112D is arranged on the side of the cutting element 112 facing the rim of the spout portion 204. In a radial direction the protrusion 112D is sized to be in contact with the membrane portion 202, the flange portion extending radially outwards above the connection portion seen in FIG. 3, during most of the first application of the cap onto the neck. This is further indicated in FIG. 4.

In the present embodiment the protusion 112D has an elongate shape extending along a downstream edge 112C of the cutting element 112, i.e. along an edge remote to the cutting region 112A. The feature that the protrusion 112D has a shape following the shape of the downstream edge 112C is a preferred feature. It is also preferred that the edge of the protrusion 112D facing the downstream edge 112C is provided with a radius. The radius preferably extends over at least the portion of the edge being in contact with the membrane portion during initial application of the cap onto the neck. In this way the amount of debris generated during initial application of the cap onto the neck will be significantly reduced as compared to a situation where the protrusion has a sharp edge, or is absent from the cutting element 112. The protrusion may also serve a similar purpose during initial opening of the closure, when the cutting element 112 may be clamped between the membrane portion and the spout portion. In such a situation the protrusion may help in reducing the amount of debris generated, or shaved off to use a pictorial terminology, from the spout.

The cap 100 may be applied onto the neck 200 in one of two ways; either the cap is pressed onto the neck in a pure axial motion, or the cap 100 is screwed onto the neck 200. For the present embodiment constructional elements have been designed to allow for the second alternative, such as e.g. the design of the stop lugs 208. In each situation the cap is first arranged in a holder after which it is aligned with the neck, and thereafter is is positioned onto the neck by means of a rotational motion combined with an axial translation, or a pure rotational motion. Aligned with the neck may be restricted to that the cap is in line with the neck, i.e. that the neck and the cap have a common central axis corresponding to the axis of rotational symmetry for the main constructional features. This is a basic level of alignment. Further details may be that the cap is positioned at a particular distance from the neck, but more commonly a further level of alignment includes that the cap and neck has a particular angular relationship, e.g. that a thread start in the cap is aligned with a thread start on the neck in order to make the process more efficient. The cap and neck may be manufactured as an assembly and applied to a packaging container in assembled state. However, the basic invention and embodiments thereof may also be manufactured such that the neck is formed on an packaging container after which the cap is applied to the packaging container now provided with a neck portion.

The present invention may also relate to a manufacturing method of a cap/spout assembly and of a packaging container having such cap/spout assembly In order to provide for that the cap easily can cut off the membrane of the spout the cap may be made of a harder material than the spout, e.g. the cap may be made of polypropylene and the spout may be made of high density polypthylene (HDPE). However, other plastic material suitable to be used for liquid food may be used as well, such as low density polyethylene (LDPE) and medium density polyethylene (MDPE). The skilled person realized that the present invention relates to technical features not associated to particular materials as such. Suitable manufacturing methods for both the neck and the cap resides within the field of plastic moulding. For the cap injection moulding may be used, and as an alternative injection/compression or even pure compression, and the same is true for the neck, although with an emphasis of injection/compression.

The invention has mainly been described above with reference to a few embodiments. However, as is readily appreciated by a person skilled in the art, other embodiments than the ones disclosed above are equally possible within the scope of the invention, as defined by the appended patent claims.

Known details of opening devices of the cut-and-collect type (where a membrane portion is removed and localized by e.g. a cap) have been omitted from the description not to interfere with the description of the present invention.

The invention claimed is:

1. A cap arranged to interact with a neck, said cap comprising:

a top portion;

a sidewall portion projecting axially from the top portion and formed in one piece with the top portion, the sidewall portion comprising an interior threading arranged to interact with exterior threading of the neck during an opening operation and during a closing operation;

a tamper evidence removably attached to the sidewall portion;

the sidewall portion further comprising cutting elements having a first end hingedly attached to the sidewall portion and a free end portion arranged to interact with a membrane portion of the neck, wherein the hinged attachment allows for the cutting element to pivot in an axial direction;

wherein that the free end portion has a blunt tip and a comparatively sharper cutting edge on a lateral side of the free end portion; and wherein the cutting elements each comprise a local protrusion extending from an axial side of the cutting element.

2. The cap of claim 1, wherein the blunt tip of the cutting elements are arranged to penetrate the neck in the region of the membrane portion during a first sequence of a first opening operation, and wherein the cutting edge is arranged to cut the membrane portion from the neck during later stages of the first opening operation, and wherein the cutting elements are arranged to hold the removed membrane portion in an area between the cutting elements and the top portion.

3. The cap of claim 1, wherein the local protrusion is arranged at the axial side facing the tamper evidence and/or to a side remote to the cutting edge.

4. The cap of claim 1, wherein the local protrusion has an elongated extension in a radial direction, such that it may be in contact with a newly cut edge of the neck during the first opening operation.

5. The cap of claim 1, wherein stop elements extend from the top portion along the sidewall portion, preferably being formed in one piece therewith, the stop elements being configured to contact a cooperating circumferential counter element of the neck to limit the movement of the cap in an axial direction.

6. The cap of claim 1, wherein the cap is moulded in one piece.

7. The cap of claim 1, wherein the cap is made of polypropylene.

8. A method for arranging a cap of claim 1 onto a neck, comprising:

arranging the cap in a cap-holder device;

aligning the cap with a neck; and positioning the cap onto the neck by relative axial movement.

9. The method of claim 8, wherein the step of positioning the cap also comprises a relative rotational motion.

10. The method of claim 8, further comprising the preceding step of moulding a neck onto a paper-based container sleeve.

11. A cap configured to be mounted on a neck of a container provided with an exterior thread, the cap comprising:

a top portion;

a sidewall portion projecting axially from the top portion and formed in one piece with the top portion to surround an interior of the cap, the sidewall portion comprising an interior thread configured to threadably engage the exterior thread of the neck during an opening operation and during a closing operation;

a tamper evidence removably attached to the sidewall portion;

the sidewall portion further comprising a plurality of cutting elements each possessing a first end hingedly attached to the sidewall portion so that each cutting element projects inwardly toward the interior of the cap and is pivotable in an axial direction, each cutting element also possessing a free end portion configured to interact with a membrane portion of the neck to separate the membrane portion from a spout portion of the neck; and wherein the cutting elements each comprise a local protrusion extending from an axial side of the cutting element.

12. The cap of claim 11, wherein each of the cutting elements possesses a free end portion at which is located a blunt tip and a cutting edge on a lateral side of the free end portion that is sharper than the blunt tip.

13. The cap of claim 11, wherein a total number of the cutting elements projecting inwardly toward the interior of the cap is five.

14. The cap of claim 11, further comprising a stop element formed in one piece with the sidewall portion, the stop element extending axially along only an upper part of the sidewall portion and projecting inwardly from the sidewall portion to contact a counter element of the neck to limit axial movement of the cap and prevent damage to the membrane portion.

15. A cap configured to be mounted on a neck of a container provided with an exterior thread, the cap comprising:

a top portion;

a sidewall portion projecting axially from the top portion and formed in one piece with the top portion to surround an interior of the cap, the sidewall portion comprising an interior thread configured to threadably engage the exterior thread of the neck during an opening operation and during a closing operation;

a tamper evidence removably attached to the sidewall portion;

the sidewall portion further comprising a plurality of cutting elements each possessing a first end hingedly attached to the sidewall portion so that each cutting element projects inwardly toward the interior of the cap and is pivotable in an axial direction, each cutting element also possessing a free end portion configured to interact with a membrane portion of the neck to separate the membrane portion from a spout portion of the neck;

at least one stop element formed in one piece with the sidewall portion, the stop element extending axially along an upper part of the sidewall portion and projecting inwardly from the sidewall portion to contact a counter element of the neck to limit axial movement of the cap and prevent damage to the membrane portion; and the at least one stop element terminating at an end that is spaced from the interior thread so that the interior thread is positioned axially between the end of the at least one stop element and the tamper evidence.

16. The cap of claim 15, wherein each of the cutting elements possesses a free end portion at which is located a blunt tip and a cutting edge on a lateral side of the free end portion that is sharper than the blunt tip.

17. The cap of claim 15, wherein the at least one stop element comprises a plurality of circumferentially spaced-apart stop elements.

18. The cap of claim 17, wherein the plurality of circumferentially spaced-apart stop elements each terminate at a respective end that is spaced from the interior thread so that the interior thread is positioned axially between the end of each of the stop elements and the tamper evidence.

* * * * *